US009422617B2

(12) United States Patent
Li et al.

(10) Patent No.: US 9,422,617 B2
(45) Date of Patent: Aug. 23, 2016

(54) CERMET THERMAL SPRAY POWDER, ROLLER FOR MOLTEN METAL PLATING BATH, ARTICLE IN MOLTEN METAL PLATING BATH

(71) Applicant: NIPPON STEEL & SUMIKIN HARDFACING CO., LTD., Koto-ku, Tokyo (JP)

(72) Inventors: Yu Li, Tokyo (JP); Masahiro Noguchi, Tokyo (JP); Tatsuhiro Shigemitsu, Tokyo (JP)

(73) Assignee: NIPPON STEEL & SUMIKIN HARDFACING CO., LTD., Tokyo (JP)

( * ) Notice: Subject to any disclaimer, the term of this patent is extended or adjusted under 35 U.S.C. 154(b) by 0 days.

(21) Appl. No.: 14/649,112

(22) PCT Filed: Feb. 7, 2014

(86) PCT No.: PCT/JP2014/000661

§ 371 (c)(1),
(2) Date: Jun. 2, 2015

(87) PCT Pub. No.: WO2014/155931

PCT Pub. Date: Oct. 2, 2014

(65) Prior Publication Data

US 2015/0322558 A1 Nov. 12, 2015

(30) Foreign Application Priority Data

Mar. 29, 2013 (JP) ..... 2013-071326

(51) Int. Cl.

| | |
|---|---|
| ***C23C 4/06*** | (2016.01) |
| ***C23C 4/12*** | (2016.01) |
| ***C23C 4/10*** | (2016.01) |
| ***C23C 2/00*** | (2006.01) |

(52) U.S. Cl.

CPC . *C23C 4/06* (2013.01); *C23C 2/003* (2013.01); *C23C 4/10* (2013.01); *C23C 4/12* (2013.01); *Y10T 428/31678* (2015.04)

(58) Field of Classification Search

USPC ..... 428/457, 469, 698, 704

See application file for complete search history.

(56) References Cited

U.S. PATENT DOCUMENTS

| | | | |
|---|---|---|---|
| 6,984,255 | B2 | 1/2006 | Itsukaichi et al. |
| 2010/0075133 | A1 | 3/2010 | Ikeda et al. |

FOREIGN PATENT DOCUMENTS

| | | | |
|---|---|---|---|
| CN | 101688285 | A | 3/2010 |
| JP | 01-259117 | * | 10/1989 |
| JP | H03-094048 | A | 4/1991 |
| JP | H07-011420 | A | 1/1995 |
| JP | H09-268362 | A | 10/1997 |
| JP | 2000-144358 | A | 5/2000 |
| JP | 2004-353045 | * | 12/2004 |
| JP | 2004-353046 | A | 12/2004 |
| JP | 2011-127171 | A | 6/2011 |

OTHER PUBLICATIONS

Korea Patent Office, "Office Acton for KR 10-2015-7014625," Nov. 13, 2015.

PCT, "International Search Report for PCT/JP2014/000661".

China Patent Office, "Office Acton for Chinese Patent Application No. 201480003497.0," Feb. 24, 2016.

* cited by examiner

*Primary Examiner* — Archene Turner

(74) *Attorney, Agent, or Firm* — Manabu Kanesaka

(57) ABSTRACT

A cermet thermal spray powder generates a dense sprayed coating with superior wear resistance, superior toughness, superior resistance to molten metal, and superior resistance to thermal shock. The cermet thermal spray powder is sprayed onto a surface of a roller for a molten metal plating bath, wherein the powder includes: a first boride including W; a second boride including Cr; binder alloy particles including at least W, Cr, and Co; and unavoidable impurities; the content of B being 4.5% by mass to 8.5% by mass and the content of W being 50% by mass to 85% by mass with respect to 100% by mass of the cermet thermal spray powder.

5 Claims, No Drawings

CERMET THERMAL SPRAY POWDER, ROLLER FOR MOLTEN METAL PLATING BATH, ARTICLE IN MOLTEN METAL PLATING BATH

RELATED APPLICATIONS

The present application is National Phase of International Application No. PCT/JP 2014/000661 filed Feb. 7, 2014, and claims priority from Japanese Application No. 2013-071326, filed Mar. 29, 2013, the disclosure of which is hereby incorporated by reference herein in its entirety.

TECHNICAL FIELD

The present invention relates, for example, to a roller for a molten metal plating bath and a cermet thermal spray powder to be thermally sprayed onto the surface of the roller.

BACKGROUND ART

One known method of forming a plated coating on the surface of a steel plate is to immerse the steel plate in a pot containing a molten metal such as zinc, aluminum, or a zinc-aluminum alloy. Molten metal pot rollers (such as a sink roller) for continuous plating of the steel plate are placed in the pot. However, the molten metal may dissolve and corrode the molten metal pot rollers. One known countermeasure against corrosion is a method of coating the surface of a roller with a protective thermally sprayed coating.

Patent Literature 1 discloses a method of forming a thermally sprayed coating on a molten metal pot roller. Specifically, a molten metal-immersed member having a thermally sprayed layer on the surface of the roller is disclosed. The thermally sprayed layer includes 5 to 15% by weight of Co with the balance being one kind or two or more kinds of tungsten carbide, titanium carbide, niobium carbide, and molybdenum carbide, one kind or two or more kinds of tungsten boride, molybdenum boride, and titanium boride, and unavoidable impurities.

Patent Literature 2 discloses a boride-based cermet thermal spray powder formed of a composite powder composition including B: 2.5 to 4.0% by weight, Co: 15.0 to 30.0% by weight, Cr: 5.0 to 10.0% by weight, and Mo: 3.0 to 6.0% by weight with the balance being W and unavoidable impurities.

Patent Literature 3 discloses a boride-based cermet thermal spray powder formed of a composite powder composition composed of Mo: 30.0% by mass or more, B: 5.0 to 12.0% by mass, Co: 10.0 to 40.0% by mass, Cr: 16.0 to 25.0% by mass, and unavoidable impurities.

CITATION LIST

Patent Literature

Patent Literature 1: Japanese Patent No. 2553937
Patent Literature 2: Japanese Patent No. 3134768
Patent Literature 3: Japanese Patent No. 4359442

SUMMARY OF INVENTION

Technical Problem

However, in the configuration of Patent Literature 1, Co in the form of simple metal that serves as a binder is present in the thermally sprayed coating. Therefore, when the thermally sprayed coating is immersed in a molten metal such as Zn—Al, Co is easily dissolved in the molten metal, and this causes erosion and exfoliation of the thermally sprayed coating, so that the thermally sprayed coating may not yield sufficient performance as a coating for a plating bath. In order to continuously reuse the thermally sprayed pot roller used once, the plating metal adhering to the thermally sprayed coating may be chemically removed using an acidic liquid such as sulfuric acid or phosphoric acid. In this case, for example, the Co in the form of simple metal that remains in the thermally sprayed coating may dissolve in the acid. This causes corrosion of the thermally sprayed coating, so that the thermally sprayed pot roller cannot be reused.

One possible method of reducing the amount of Co in the form of simple substance in the thermally sprayed coating without causing a reduction in the adhesion of the thermally sprayed coating and interparticle bonding force is a method of allowing the thermal spray materials to partially react with each other using the thermal energy of thermal spray flame to thereby generate double carbides such as $Co_3W_3C$ and double borides (i.e., ceramics). However, since the double carbides include brittle $Co_3W_3C$ (η phase), the toughness of the thermally sprayed coating is reduced, and cracks occur. The molten metal such as Zn—Al infiltrates into the boundary with the base through the cracks serving as infiltration paths and causes exfoliation of the thermally sprayed coating.

In Patent Literature 2, the binder is composed of Co, Cr, and Mo in the form of simple metals, and therefore small amounts of Co, Cr, and Mo in the form of simple metals remain in the thermally sprayed coating. These remaining Cr and Mo are easily oxidized in a high-temperature environment and therefore easily cause deterioration of the thermally sprayed coating during long-term use. Since simple metals such as Co have low resistance to corrosion by molten metal as described above, the possibility that exfoliation occurs in the thermally sprayed coating is high.

In Patent Literature 3, since a component system formed mainly of Mo is used, it is difficult to form a dense thermally sprayed coating. When the thermally sprayed coating is used for a long time in a high-temperature environment, the toughness of the thermally sprayed coating is reduced, so that the thermally sprayed coating is easily cracked. Therefore, when a roller thermally-sprayed with the thermal spray powder in Patent Literature 3 is immersed in molten zinc, the possibility that zinc infiltrates into the thermally sprayed coating at an early stage to thereby cause exfoliation is high.

The properties required for the thermally sprayed coating of a pot roller include resistance to cracking, i.e., toughness. For example, in a sink roller, grooves are formed in order to prevent meandering and slippage of a steel plate, adhesion of dross to the surface of the roller, etc. It is known that stress concentration caused by the difference in thermal expansion between the material of the sink roller and the thermally sprayed coating is more likely to occur in the bottom of each groove and therefore cracks easily occur in the thermally sprayed coating in the bottom of the groove. In addition, since the pot roller is removed from the high-temperature molten metal during maintenance, the pot roller is necessary to be resistant to repeated heating and cooling, i.e., to have thermal shock residence.

Accordingly, it is an object of the present invention to provide a cermet thermal spray powder that can generate a dense thermally sprayed coating excellent in wear resistance, toughness, molten metal resistance, and thermal shock resistance and also provide a molten metal pot roller.

Solution to Problem

The present inventors have conducted extensive studies on the above problems and obtained the following findings.

The present invention is a cermet thermal spray powder to be thermally sprayed onto a roller surface of a roller for a molten metal plating bath. The cermet thermal spray powder is characterized by comprising a first boride including W, a second boride including Cr, binder alloy particles including at least W, Cr, and Co, and unavoidable impurities, the content of B being 4.5% by mass or more and 8.5% by mass or less, and the content of W being 50% by mass or more and 85% by mass or less with respect to 100% by mass of the cermet thermal spray powder.

The use of the binder alloy particles including W that is included in the first boride and the transition metal (Cr) that is included in the second boride allows the wettability between boride particles and the binder alloy particles during thermal spraying to be improved. Therefore, a dense thermally sprayed coating is easily generated, and the generation of a double boride to be included in the thermally sprayed coating can be facilitated.

The present invention is a cermet thermal spray powder to be thermally sprayed onto a roller surface of a roller for a molten metal plating bath. The cermet thermal spray powder is characterized by comprising a first boride including W, a second boride including Co, binder alloy particles including at least W, Cr, and Co, and unavoidable impurities, the content of B being 4.5% by mass or more and 8.5% by mass or less, and the content of W being 50% by mass or more and 85% by mass or less with respect to 100% by mass of the cermet thermal spray powder.

The use of the binder alloy particles including W that is included in the first boride and the transition metal (Co) that is included in the second boride allows the wettability between boride particles and the binder alloy particles during thermal spraying to be improved. Therefore, a dense thermally sprayed coating is easily generated, and the generation of a double boride to be included in the thermally sprayed coating can be facilitated.

The present invention is a cermet thermal spray powder to be thermally sprayed onto a roller surface of a roller for a molten metal plating bath. The cermet thermal spray powder is characterized by comprising a first boride including W, a second boride including Ti, binder alloy particles including at least W, Ti, and Co, and unavoidable impurities, the content of B being 4.5% by mass or more and 8.5% by mass or less, and the content of W being 50% by mass or more and 85% by mass or less with respect to 100% by mass of the cermet thermal spray powder.

The use of the binder alloy particles including W that is included in the first boride and the transition metal (Ti) that is included in the second boride allows the wettability between boride particles and the binder alloy particles during thermal spraying to be improved. Therefore, a dense thermally sprayed coating is easily generated, and the generation of a double boride to be included in the thermally sprayed coating can be facilitated.

In the above configurations, if the content of B included in the first and second borides exceeds 8.5% by mass, the toughness and thermal shock resistance of a thermally sprayed coating are reduced. If the content of B included in the first and second borides is less than 4.5% by mass, the amount of double boride generated becomes small, and the amount of pores in the thermally sprayed coating becomes large. In addition, since the amount of boride and double boride becomes small, the hardness of the thermally sprayed coating becomes low, and this causes a reduction in wear resistance. Therefore, the content of B included in the first and second borides is limited to 4.5% by mass or more and 8.5% by mass or less.

If the content of W is less than 50% by mass, the kinetic energy of thermally spray particles sprayed toward the roller surface is small, so that a dense thermally sprayed coating cannot be generated. If the content of W exceeds 85% by mass, the thermal energy required to form a thermally sprayed coating per unit mass increases. Therefore, the amount of pores in the thermally sprayed coating rise, and this causes a significant reduction in deposition yield. Therefore, the content of W is limited to 50% by mass to 85% by mass with respect to 100% by mass of the cermet thermal spray powder.

Any of the above cermet thermal spray powders can be thermally sprayed onto the roller surfaces of pot rollers. The pot rollers are placed in a high-temperature molten zinc plating bath (about 450° C.) or a molten aluminum plating bath (700 to 800° C.). The pot rollers include a sink roller and a support roller. By rotating the pot rollers to cause a steel plate to pass through, for example, the high-temperature molten zinc plating bath, the surface of the steel plate can be plated uniformly with zinc or aluminum. The thermal spraying method used may be any known method such as a high-velocity gas flame thermal spraying method or a plasma thermal spraying method. Any of the above cermet thermal spray powders can be thermally sprayed onto the surface of an article in a molten metal plating bath. Examples of the article in the bath include bearings and shaft sleeves of the pot rollers.

Thermal spraying of any of the above cermet thermal spray powders can provide a roller for a molten metal plating bath that has a roller surface provided with a thermally sprayed coating including 25% by mass or less of CoCrW alloy particles and further including CoWB, $CoW_2B_2$, and WB in a total amount of 50% by mass to 92% by mass. In this case, the content of B is 4.5% by mass or more and 8.5% by mass or less, and the content of W is 50% by mass or more and 85% by mass or less.

Advantageous Effects of Invention

The present invention can provide a cermet thermal spray powder that can form a dense thermally sprayed coating excellent in wear resistance, toughness, molten metal resistance, pickling resistance, and thermal shock resistance.

DESCRIPTION OF EMBODIMENTS

The present invention will be described more specifically by way of Examples. For each of a plurality of Examples and Comparative Examples, wear resistance, toughness, molten metal resistance, pickling resistance, thermal shock resistance, and porosity were evaluated. TABLE 1 shows test data on evaluation of wear resistance, toughness, pickling resistance, thermal shock resistance, and porosity in each of Examples 1 to 8, and the compositions of the borides and binder alloy particles in each of the Examples are also shown. TABLE 2 shows test data on evaluation of wear resistance, toughness, pickling resistance, thermal shock resistance, and porosity in each of Comparative Examples 1 to 10, and the compositions of the borides and binder alloy particles in each of the Comparative Examples are also shown. TABLE 3 shows test data on evaluation of molten metal resistance in each of Examples 1 to 8 and Comparative Examples 1 to 10. TABLE 4 shows the chemical composition and major crystal phases of each of the thermally sprayed coatings in Examples 1 to 8 and Comparative Examples 1 to 10.

TABLE 1

| | FIRST BORIDE | SECOND BORIDE | BINDER ALLOY PARTICLES | WEAR RESIS-TANCE | TOUGH-NESS | PICKLING RESIS-TANCE | THERMAL SHOCK RESISTANCE | POROSITY |
|---|---|---|---|---|---|---|---|---|
| EXAMPLE 1 | WB (69.3%) | $CrB_2$ (13.7%) | CoCrW ALLOY (17%) | A | A | A | A | A |
| EXAMPLE 2 | WB (70%) | $CrB_2$ (7%) | STELLITE #6 (23%) | A | A | A | A | A |
| EXAMPLE 3 | WB (61.2%) | $CrB_2$ (17%) | STELLITE #12 (21.8%) | A | A | A | A | A |
| EXAMPLE 4 | WB (54.3%) | $CoB_2$ (12%) | CoCrW ALLOY (33.7%) | A | A | A | A | A |
| EXAMPLE 5 | WB (64%) | $CoB_2$ (11.4%) | STELLITE #6 (34.6%) | A | A | A | A | A |
| EXAMPLE 6 | WB (52%) | $TiB_2$ (14.2%) | CoWTi ALLOY (33.8%) | A | A | A | A | A |
| EXAMPLE 7 | WB (67.3%) | $TiB_2$ (13%) | CoWTi ALLOY (19.7%) | A | A | A | A | A |
| EXAMPLE 8 | WB (83%) | $CrB_2$ (8%) | CoCrW ALLOY (9%) | A | A | A | A | A |

TABLE 2

| | STARTING MATERIAL | BINDER | WEAR RESIS-TANCE | TOUGH-NESS | THERMAL SHOCK RESISTANCE | PICKLING RESIS-TANCE | POROSITY |
|---|---|---|---|---|---|---|---|
| COMPARATIVE EXAMPLE 1 | WC(88.8%) | Co(11.2%) | A | C | C | A | A |
| COMPARATIVE EXAMPLE 2 | WC(34%) WB(17%) | Co(11.2%) | A | C | C | C | A |
| COMPARATIVE EXAMPLE 3 | WB(70%) | Co(18%) Cr(8%) Mo(4%) | B | C | B | C | A |
| COMPARATIVE EXAMPLE 4 | WB(66.8%) $CrB_2$(8.8%) | Co(16.7%) Cr(7.7%) | A | A | C | B | A |
| COMPARATIVE EXAMPLE 5 | WB(76.3%) | STELLITE #6 (23.7%) | C | B | C | A | C |
| COMPARATIVE EXAMPLE 6 | MoB(15%) | Co(15%) Cr(17%) | B | C | C | C | A |
| COMPARATIVE EXAMPLE 7 | MoB(57%) $CrB_2$(10%) | Co(22%) Cr(11%) | B | C | C | B | A |
| COMPARATIVE EXAMPLE 8 | WB(50%) $CrB_2$(40%) | CoCrW ALLOY (10%) | A | C | C | B | C |
| COMPARATIVE EXAMPLE 9 | WB(52%) $CrB_2$(8%) | CoCrW ALLOY (40%) | C | A | A | A | A |
| COMPARATIVE EXAMPLE 10 | WB(91%) $TiB_2$(4.5%) | CoTiW ALLOY (4.5%) | B | A | A | B | C |

TABLE 3

| | 200 HOURS | 300 HOURS | 400 HOURS | 500 HOURS | EVALUATION |
|---|---|---|---|---|---|
| EXAMPLE 1 | A | A | A | A | A |
| EXAMPLE 2 | A | A | A | A | A |
| EXAMPLE 3 | A | A | A | A | A |
| EXAMPLE 4 | A | A | A | A | A |
| EXAMPLE 5 | A | A | A | A | A |
| EXAMPLE 6 | A | A | A | A | A |
| EXAMPLE 7 | A | A | A | A | A |
| EXAMPLE 8 | A | A | A | A | A |
| COMPARATIVE EXAMPLE 1 | A | C | | | C |
| COMPARATIVE EXAMPLE 2 | A | C | | | C |
| COMPARATIVE EXAMPLE 3 | A | A | C | | C |
| COMPARATIVE EXAMPLE 4 | A | A | C | | C |
| COMPARATIVE EXAMPLE 5 | A | B | C | | C |
| COMPARATIVE EXAMPLE 6 | A | C | | | C |
| COMPARATIVE EXAMPLE 7 | A | A | C | | C |

TABLE 3-continued

| | 200 HOURS | 300 HOURS | 400 HOURS | 500 HOURS | EVALUATION |
|---|---|---|---|---|---|
| COMPARATIVE EXAMPLE 8 | A | A | B | C | C |
| COMPARATIVE EXAMPLE 9 | A | A | A | B | B |
| COMPARATIVE EXAMPLE 10 | A | B | C | | C |

TABLE 4

| | CHEMICAL COMPONENTS (wt %) | | | | | | | | |
|---|---|---|---|---|---|---|---|---|---|
| | W | Cr | Co | B | Ti | Mo | C | BALANCE | MAJOR CRYSTAL PHASES |
| EXAMPLE 1 | 66.60% | 15.70% | 11.60% | 6.10% | | | | | CoW2B2, CrB2, CrB, Co(Cr) |
| EXAMPLE 2 | 66.80% | 12.30% | 15.10% | 5.30% | | | 0.20% | <1.0% | CoW2B2, CrB2, CrB, Co(Cr) |
| EXAMPLE 3 | 59.70% | 20.60% | 13.10% | 6.10% | | | 0.30% | <1.0% | CoW2B2, CrB2, CrB, Co(Cr) |
| EXAMPLE 4 | 54.60% | 5.50% | 33.70% | 6.20% | | | | | CoW2B2, WCoB, CoCrB, CoB, Co(Cr) |
| EXAMPLE 5 | 52.60% | 9.70% | 31.00% | 6.10% | | | 0.30% | <1.0% | CoW2B2, WCoB, CoCrB, CoB, Co(Cr) |
| EXAMPLE 6 | 52.30% | | 25.80% | 7.30% | 14.60% | | | | CoW2B2, WCoB, TiB2, TiB, Co(Cr) |
| EXAMPLE 7 | 65.60% | | 15.90% | 7.80% | 10.70% | | | | CoW2B2, WCoB, TiB2, TiB, Co(Cr) |
| EXAMPLE 8 | 79.10% | 8.10% | 6.50% | 6.30% | | | | | WB, WCoB, CrB, CrB2 |
| COMPARATIVE EXAMPLE 1 | 83.40% | | 11.20% | | | | 5.40% | | WC, Co3W3C, W2C |
| COMPARATIVE EXAMPLE 2 | 78.10% | | 17.00% | 1.90% | | | 3.00% | | WC, Co3W3C, CoWB, W2C, Co |
| COMPARATIVE EXAMPLE 3 | 66.10% | 8.00% | 18.00% | 3.90% | | 4.00% | | | CoW2B2, Co, Co3Mo, Co7Mo6 |
| COMPARATIVE EXAMPLE 4 | 63.10% | 15.10% | 16.70% | 5.10% | | | | | CoW2B2, Co, Cr |
| COMPARATIVE EXAMPLE 5 | 75.20% | 6.00% | 14.00% | 4.40% | | | 0.20% | <1.0% | CoW2B2, Co(Cr) |
| COMPARATIVE EXAMPLE 6 | | 17.00% | 15.00% | 6.90% | | 61.10% | | | MoB, MoCoB, Co, Cr |
| COMPARATIVE EXAMPLE 7 | | 19.40% | 22.00% | 7.40% | | 51.20% | | | MoB, MoCoB, CrB, CrB2, Co, Cr |
| COMPARATIVE EXAMPLE 8 | 47.70% | 36.10% | 6.80% | 9.40% | | | | | CoW2B2, CrB2, WB |
| COMPARATIVE EXAMPLE 9 | 52.80% | 13.30% | 29.50% | 4.40% | | | | | WCoB, CrB2, CrB, Co(Cr) |
| COMPARATIVE EXAMPLE 10 | 86.40% | | 3.46% | 6.40% | 3.74% | | | | WB, TiB2, TiB, WCoB |

The thermal spraying method used was a high-velocity gas flame thermal spraying method using a combustion flame of kerosene and high-pressure oxygen as a heat source. The wear resistance was evaluated using a Suga ablation tester according to JIS H8503. The wear resistance was evaluated by a change in the weight of a test piece when it was caused to slide reciprocally 2,000 times on test paper SiC #320 under a load of 29.4 N. When the wear resistance of a thermally sprayed coating was 100 DS/mg or less, the wear resistance was evaluated as "C." When the wear resistance was 100 to 200 DS/mg, it was evaluated as "B." When the wear resistance was 300 DS/mg or more, it was evaluated as "A."

The toughness was evaluated as follows. A test piece with a thermally sprayed coating generated thereon was cut in its thickness direction, and mirror polishing was performed. Then a load of 9.8 N was applied to the cross section of the thermally sprayed coating using a micro Vickers hardness meter to form an indentation, and the presence or absence of cracking around the indentation was evaluated. When no cracking was found, the toughness was good and evaluated as "A." When slight cracking was found, the toughness was slightly insufficient and evaluated as "B." When clear cracking was found, the toughness was not good and evaluated as "C."

The molten metal resistance was evaluated by the following experiment. A cermet thermal spray powder was thermally sprayed onto the surface of each of test pieces, and the test piece subjected to thermal spraying was immersed in a zinc plating bath at 450° C. for a predetermined time and then removed from the bath. Then the test piece was cooled, and whether or not the zinc adhering to the surface of the thermally sprayed coating could be stripped off was checked. The immersion time was set to 200 hours, 300 hours, 400 hours, and 500 hours, and the test was performed on the test pieces in the above order. When exfoliation or erosion of the thermally sprayed coating was found after the zinc adhering to the surface of the test piece removed from the zinc plating bath was stripped off, the test was interrupted at this point. When no exfoliation and erosion were found, the molten metal resistance was good and evaluated as "A," and the immersion test was continued. When the zinc adhering to the surface of the thermally sprayed coating was firmly fixed during the test and could not be removed by external force, the zinc was considered to react with the thermally sprayed coating. In this case, the molten metal resistance was slightly insufficient and evaluated as "B." When exfoliation of the thermally sprayed coating was found, the molten metal resistance was poor and evaluated as "C." The phenomenon in which zinc is firmly fixed to the thermally sprayed coating is considered to be a phenomenon that occurs in a stage before exfoliation starts.

The thermal shock resistance was evaluated as follows. A thermally sprayed coating test piece obtained by forming a coating on a flat plate was repeatedly subjected to heat treatment and water cooling treatment 20 times, and the degree of exfoliation was examined. The heating time was set to 30 minutes, and the heating temperature was set to 500° C. The water cooling time was set to 10 minutes. The water cooling temperature was set to 25° C. When no exfoliation was found, the thermal shock resistance was good and evaluated as "A." When slight exfoliation was found, the thermal shock resistance was slightly insufficient and evaluated as "B." When clear exfoliation was found, the thermal shock resistance was poor and evaluated as "C."

The pickling resistance was evaluated by the following experiment. A cermet thermal spray powder was thermally sprayed onto the surface of a test piece, and non-sprayed portions of the test piece material and its side surfaces were coated with a silicon resin anti-corrosive coating. Then the resultant test piece was immersed in sulfuric acid to expose the thermally sprayed coating to the sulfuric acid. After the test piece was immersed in the aqueous sulfuric acid solution for 7 days, the test piece was removed therefrom. Then the thermally sprayed coating of the test piece was observed, and the pickling resistance was evaluated according to the presence or absence of separation or exfoliation of the thermally sprayed coating. The temperature of the acidic aqueous solution was set to 40° C., and its concentration was set to 10% by volume. A test piece with no exfoliation was cut and polished, and its cross section was examined under an optical microscope. The pickling resistance of the thermally sprayed coating was evaluated as "C" when the coating was exfoliated after immersion in sulfuric acid. The pickling resistance was evaluated as "B" when a change in the structure of the thermally sprayed coating was found in the examination of the cross section. The pickling resistance was evaluated as "A" when no exfoliation and no change in the cross-sectional structure were found.

The porosity was measured using an image analysis method. After a thermally sprayed coating was cut and polished, five cross-sectional structure photographs were taken at 400× under a scanning electron microscope. The ratio of the area of pore portions in the cross-sectional structure in the photographs to the total area of the cross-sectional structure was determined to thereby compute the porosity. When the porosity was less than 1.5%, the denseness of the thermally sprayed coating was high and evaluated as "A." When the porosity was more than 3%, the denseness of the thermally sprayed coating was low and evaluated as "C."

In Comparative Examples 1 and 2, low-toughness crystal phases, i.e., $Co_3W_3C$ (η phase) and $W_2C$, were present in the thermally sprayed coating. Specifically, decarburization of double carbide and carbide occurred, and cracking occurred in the thermally sprayed coating. Therefore, the toughness was evaluated as "C." The thermally sprayed coating including these tungsten carbides is easily oxidized at high temperature. Therefore, the thermal shock resistance was evaluated as "C."

In Comparative Example 3, Co in the form of simple metal remained in the thermally sprayed coating and easily dissolved in an acidic solution such as sulfuric acid. Therefore, the pickling resistance was evaluated as "C." In Comparative Example 4, since Co and Cr in the formed of simple metals remained in the thermally sprayed coating, oxidation occurred rapidly at high temperature. Therefore, the thermal shock resistance was evaluated as "C." In Comparative Example 5, since the porosity of the thermally sprayed coating was high, the hardness of the thermally sprayed coating was low, so that the wear resistance and toughness of the thermally sprayed coating were poor.

In Comparative Examples 6 and 7, double boride (MoCoB) generated during thermal spraying was decomposed when heat treatment was performed at a temperature of 450° C. or higher for 24 hours or longer. Therefore, the thermally sprayed coating became brittle, and its toughness was reduced. The toughness and thermal shock resistance of the thermally sprayed coating were poor. In addition, since small amounts of Co and Cr in the form of simple metals were present in the thermally sprayed coating, the pickling resistance was evaluated as "C" or "B."

Referring to TABLEs 2 and 4, the content of B in Comparative Example 8 was 9.40% by mass, which is larger than the upper limit, 8.5% by mass. Since an excessively large amount of boride or double boride was present in the thermally sprayed coating, the toughness of the thermally sprayed coating became low. Therefore, the thermal shock resistance was evaluated as "C." The content of W was 47.7% by mass, which is lower than the lower limit, 50% by mass. The kinetic energy of the thermally sprayed particles was thereby low, so that the amount of pores in the thermally sprayed coating became large. Therefore, the porosity was evaluated as "C." In Comparative Example 9, the content of B was 4.40% by mass, which is lower than the lower limit, 5% by mass. Therefore, the hardness was low, and the wear resistance was evaluated as "C." In Comparative Example 10, the content of W was 86.4% by mass, which is larger than the upper limit, 85% by mass. Therefore, sufficient thermal spraying heat energy was not obtained, so that the amount of pores in the thermally sprayed coating became large. Therefore, the porosity was evaluated as "C."

In Examples 1 to 8, the metal binder was alloy particles including the same metals as those in hard boride particles. Therefore, the wettability between the metal binder and the borides was good, and a dense thermally sprayed coating with low porosity was obtained. Since 4.5% by mass B 8.5% by mass and 50% by mass≤W≤85% by mass were satisfied, all the wear resistance, toughness, molten metal resistance, thermal shock resistance, and porosity were evaluated as "A." In addition, for all the Examples, no exfoliation was found even after immersion for 500 hours in the molten metal resistance test. Specifically, Co, Cr, etc. in the metal binder reacted with the first boride and the second boride, so that double boride could be actively generated in the thermally sprayed coating. Since the metal binder not reacted with the first boride and the second boride remained in the form of the alloy in the thermally sprayed coating, the molten metal resistance, the thermal shock resistance, and the pickling resistance were increased.

The invention claimed is:

1. A cermet thermal spray powder to be thermally sprayed onto a roller surface of a roller for a molten metal plating bath, the cermet thermal spray powder comprising:

a first boride including W, a second boride including Cr, binder alloy particles including at least W, Cr, and Co, and unavoidable impurities, a content of B being 4.5% by mass or more and 8.5% by mass or less, and a content of W being 50% by mass or more and 85% by mass or less with respect to 100% by mass of the cermet thermal spray powder.

2. A cermet thermal spray powder to be thermally sprayed onto a roller surface of a roller for a molten metal plating bath, the cermet thermal spray powder comprising:

a first boride including W, a second boride including Co, binder alloy particles including at least W, Cr, and Co, and unavoidable impurities, a content of B being 4.5% by mass or more and 8.5% by mass or less, and a content of W being 50% by mass or more and 85% by mass or less with respect to 100% by mass of the cermet thermal spray powder.

3. A cermet thermal spray powder to be thermally sprayed onto a roller surface of a roller for a molten metal plating bath, the cermet thermal spray powder comprising:

a first boride including W, a second boride including Ti, binder alloy particles including at least W, Ti, and Co, and unavoidable impurities, a content of B being 4.5% by mass or more and 8.5% by mass and a content of W being 50% by mass or more and 85% by mass or less with respect to 100% by mass of the cermet thermal spray powder.

4. A roller for a molten metal plating bath, having a roller surface thermally sprayed with the cermet thermal spray powder according to claim 1.

5. An article in a molten metal plating bath, having a surface thermally sprayed with the cermet thermal spray powder according to claim 1.

* * * * *